US008381560B2

(12) United States Patent
Mizumura et al.

(10) Patent No.: US 8,381,560 B2
(45) Date of Patent: Feb. 26, 2013

(54) HYDROFORMING METHOD

(75) Inventors: Masaaki Mizumura, Tokyo (JP); Yukihisa Kuriyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 542 days.

(21) Appl. No.: 12/450,927

(22) PCT Filed: Apr. 18, 2008

(86) PCT No.: PCT/JP2008/057992

§ 371 (c)(1),
(2), (4) Date: Oct. 15, 2009

(87) PCT Pub. No.: WO2008/130055

PCT Pub. Date: Oct. 30, 2008

(65) Prior Publication Data

US 2010/0116011 A1 May 13, 2010

(30) Foreign Application Priority Data

Apr. 18, 2007 (JP) ..... 2007-109632

(51) Int. Cl.
*B21D 39/20* (2006.01)

(52) U.S. Cl. ..... 72/58; 72/61

(58) Field of Classification Search ..... 72/57, 58, 72/60, 61, 62, 370.22; 29/421.1
See application file for complete search history.

(56) References Cited

U.S. PATENT DOCUMENTS

| | | | | |
|---|---|---|---|---|
| 5,802,899 | A * | 9/1998 | Klaas et al. | 72/58 |
| 6,105,409 | A * | 8/2000 | Kojima et al. | 72/58 |
| 6,766,678 | B1 * | 7/2004 | Schulze et al. | 72/369 |
| 7,204,114 | B2 * | 4/2007 | Ni et al. | 72/61 |

(Continued)

FOREIGN PATENT DOCUMENTS

| | | |
|---|---|---|
| JP | 2002-153917 | 5/2002 |
| JP | 2002-219525 | 8/2002 |

(Continued)

OTHER PUBLICATIONS

International Search Report dated Jul. 15, 2008 issued in corresponding PCT Application No. PCT/JP2008/057992.

(Continued)

*Primary Examiner* — Edward Tolan

(74) *Attorney, Agent, or Firm* — Kenyon & Kenyon LLP

(57) ABSTRACT

The present invention provides a hydroforming method able to increase the expansion ratio to obtain a complicated shape hydroformed product and able to reduce the number of steps of work, that is, a hydroforming method loading a metal pipe into a divided mold, clamping the mold, then applying an internal pressure and pushing force in the pipe axial direction to said metal pipe, comprising, in a first hydroforming step, expanding said metal pipe in one direction of said metal pipe cross-section to obtain an intermediate product having a circumferential length of 90% to 100% of the circumferential length of the product shape in all of the expanded part in the pipe axial direction and having a height greater than the height of the product in said one direction and at least part of the pipe axial direction, then, in a second hydroforming step, reducing the height in the one direction of said intermediate product in all or part of the pipe axial direction while shaping the product to the final product shape. Further, in the case of a shape including bending, a bending step is performed between the above first hydroforming step and second hydroforming step.

4 Claims, 20 Drawing Sheets

U.S. PATENT DOCUMENTS

| | | | | |
|---|---|---|---|---|
| 7,337,641 | B1 * | 3/2008 | Bruggemann | 72/58 |
| 7,464,572 | B2 * | 12/2008 | Miyanaga et al. | 72/58 |
| 7,484,393 | B2 * | 2/2009 | Tomizawa | 72/57 |
| 7,695,824 | B2 * | 4/2010 | Gejima et al. | 428/586 |

FOREIGN PATENT DOCUMENTS

| | | |
|---|---|---|
| JP | 2003-88927 | 3/2003 |
| JP | 2003-290845 | 10/2003 |
| JP | 2004-255445 | 9/2004 |
| JP | 2007-185697 | 7/2007 |

OTHER PUBLICATIONS

Sosei-to-Kakou, Journal of the Japan Society for Technology of Plasticity 45 (524): 21-26 (2004).

* cited by examiner (a)

(b)

HYDROFORMING METHOD

This application is a national stage application of International Application No. PCT/JP2008/057992, filed 18 Apr. 2008, which claims priority to Japanese Application No. 2007-109632, filed 18 Apr. 2007, which is incorporated by reference in its entirety.

TECHNICAL FIELD

The present invention relates to a method of hydroforming a metal pipe used for the production of an exhaust part, a suspension part, a body part, etc. for an automobile.

BACKGROUND ART

In recent years, in the automobile industry, metal pipe is increasingly being used as one means for reducing weight. Hollow metal pipe, compared with a solid material, offers the same rigidity while enabling the cross-sectional area to be reduced. Further, an integral structure of metal pipe, compared with a T-shaped structure obtained by welding two metal plates, enables a reduction of weight by the elimination of the need for a welded flange part.

However, auto parts are placed in narrow spaces in the automobiles. Therefore, metal pipe is seldom used as is as a straight pipe. It is almost always attached after being secondarily worked. As secondary working, bending is used most often, but in recent years the increasing complexity of the shapes of auto parts has led to an increase in hydroforming as well (fastening a metal pipe in a mold and, in that state, using inside pressure and axial direction compression to work the pipe into the mold shape) and, further, an increase in working comprised of these working processes overlaid. Hydroforming itself, as shown in FIG. 1 (see *Journal of Materials Processing Technology*, Vol. 45, No. 524 [2004], p. 715), compared with the simple T-forming, is being used for increasingly complex shapes in recent years. The pipe expansion rates (ratio of circumferential length of product pipe to circumferential length of stock pipe, in the figure, described as "expansion ratio") have also been increasing.

As the method of hydroforming with a large expansion ratio, as for example described in Japanese Patent Publication (A) No. 2002-153917, there is the method of using a movable mold to obtain a hydroformed part having a high branch pipe height. However, this method can only be applied to shapes in the case of expansion in only a certain direction such as with T-forming.

Further, Japanese Patent Publication (A) No. 2002-100318 discloses the method of expansion in one certain direction, then expansion in a direction perpendicular to that direction. If using this method, it is possible to obtain a hydroformed part expanded not only in one certain direction, but overall. However, while this can be easily applied if expanding the pipe to a simple rectangular cross-section, if a complicated cross-sectional shape, a further hydroforming step becomes necessary for finishing the part to the detailed shape. A total of three steps of hydroforming become necessary.

If performing both bending and hydroforming, in general the part is bent, then loaded into the hydroforming mold and hydroformed, but with this method, it is difficult to increase the expansion ratio of the bent part. Therefore, the method of hydroforming, then bending is also proposed in for example Japanese Patent Publication (A) No. 2002-219525. This method expands the pipe overall in the first step of hydroforming, then bends it while applying internal pressure in the second step, and finally hydroforms the part while crushing it in the direction perpendicular to the bending direction in the third step. If using this method, compared with the general method of bending, then hydroforming, it becomes possible to increase the expansion ratio of the bent part. However, the expansion ratio is limited by the limit value of the first step of hydroforming. With hydroforming expanding the pipe overall like with this method, not that large an expansion ratio can be expected.

In addition, as in Japanese Patent Application No. 2006-006693, the method of hydroforming, then rotary bending has also been proposed. However, with this method, the scope of application is limited since only rotary draw bending is covered as a bending method.

DISCLOSURE OF THE INVENTION

As explained above, in the past, it was difficult to obtain a hydroformed part of a large expansion ratio and complicated shape. As the only method, as the method shown in Japanese Patent Publication (A) No. 2002-100318, there is the method of performing the hydroforming in three steps, but with this method, there are many steps. This is disadvantageous cost wise and production efficiency wise.

Therefore, the present invention provides a method of working a hydroformed part with a large expansion ratio and complicated shape by two hydroforming steps. Further, even when bending and hydroforming are superposed, a method obtaining a shaped part in the case of a large expansion ratio of the bent part—difficult in the past—is provided.

The present invention was made for solving the above problems and has as its gist the following:

(1) A hydroforming method loading a metal pipe into a divided mold, clamping the mold, then applying an internal pressure and pushing force in the pipe axial direction to said metal pipe, which hydroforming method characterized by, in a first hydroforming step, expanding said metal pipe in one direction of said metal pipe cross-section to obtain an intermediate product having a circumferential length of 90% to 100% of the circumferential length of the product shape in all of the expanded part in the pipe axial direction and having a height greater than the height of the product in said one direction and at least part of the pipe axial direction, then, in a second hydroforming step, reducing the height in the one direction of said intermediate product in all or part of the pipe axial direction while shaping the product to the final product shape.

(2) A hydroforming method as set forth in (1) characterized in that a radius of curvature of a cross-section of the metal pipe and a radius of curvature of a cross-section in said one direction are substantially equal.

(3) A hydroforming method as set forth in (1) or (2) characterized by using a movable mold able to freely move in the axial direction of the metal pipe and a counter punch able to freely move in a direction perpendicular to the axial direction of the metal pipe to shape the intermediate product.

(4) A hydroforming method as set forth in (1), (2), or (3) characterized by bending the intermediate product in the pipe axial direction between the first hydroforming step and second hydroforming step.

Further, in the present invention (2), the "radii of curvature being substantially equal" means the radius of curvature of the cross-section of the intermediate product is a range of 90 to 110% with respect to the radius of curvature of the stock pipe (metal pipe).

BEST MODE FOR CARRYING OUT THE INVENTION

FIGS. 2 to 20 will be used to explain details of the present invention.

Figure 1:
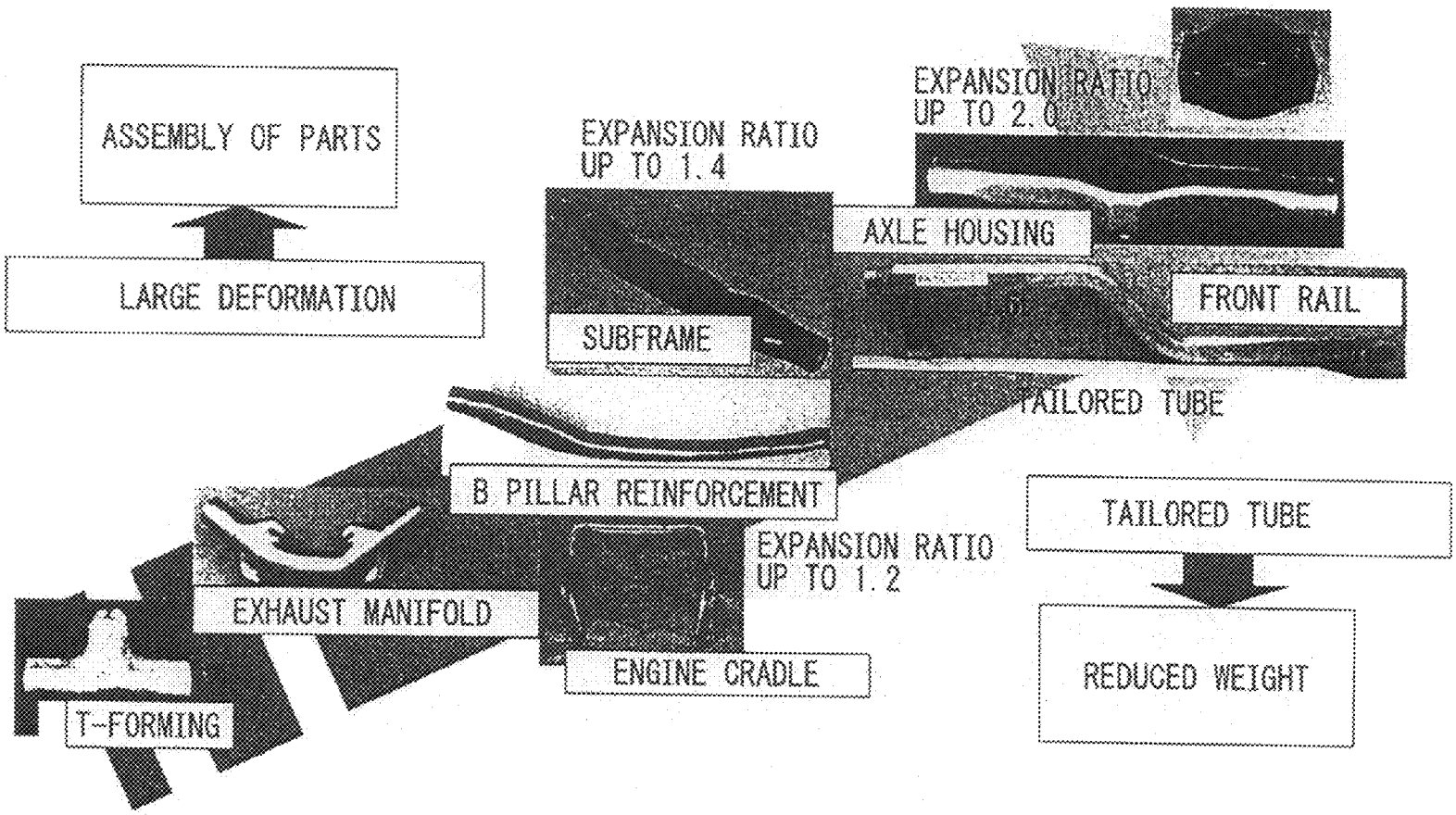
FIG. 1 is a view showing the advances made in hydroforming technology.
Figure 2:
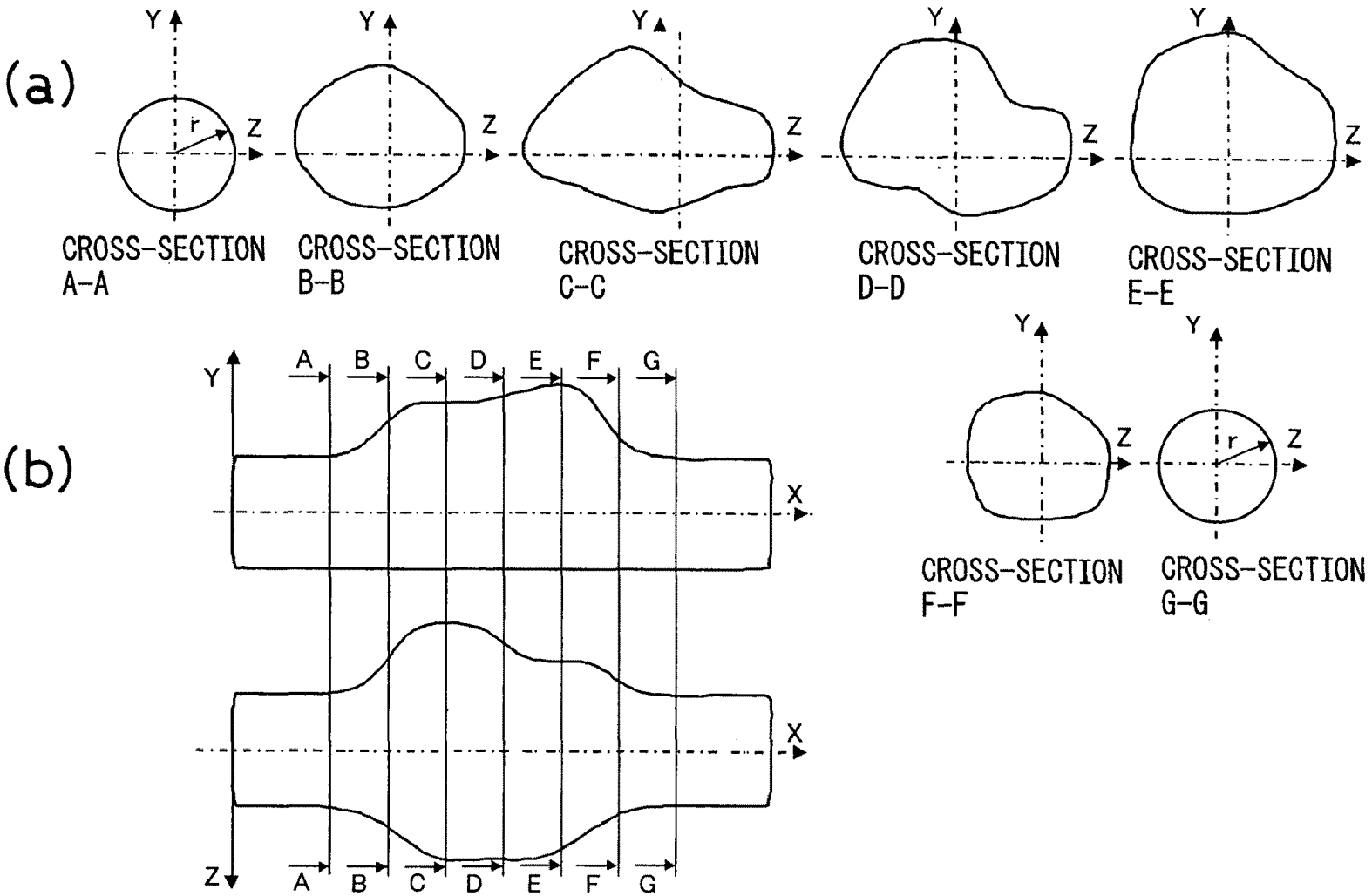
FIG. 2 are views showing explanatory views of a method for designing an intermediate product shape based on a product shape in the present invention, where (a) shows the cross-sectional shapes and (b) shows the side shapes.
Figure 3:
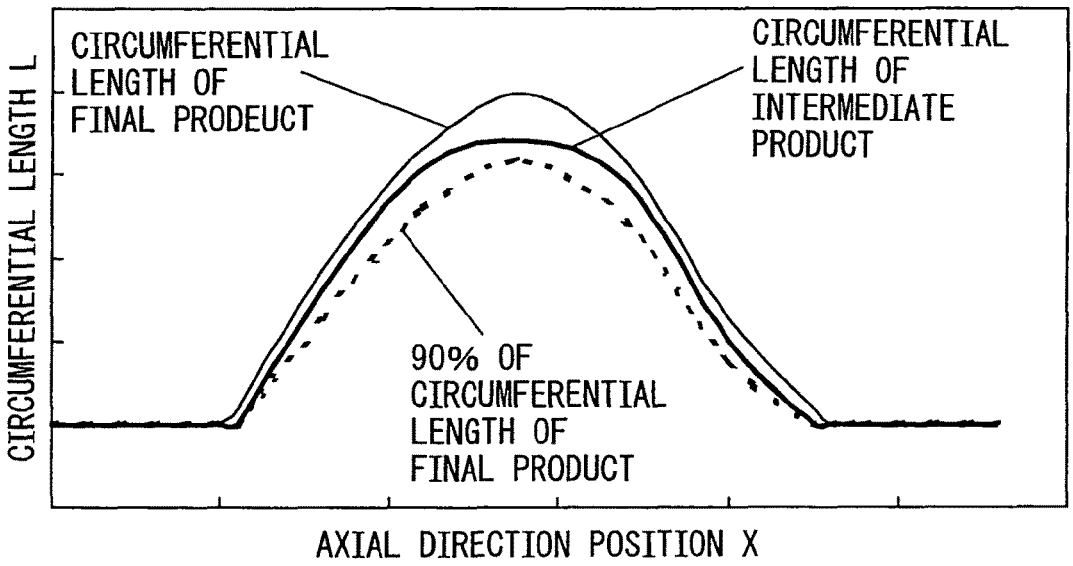
FIG. 3 is a view showing the circumferential length of the shape of the final product and the circumferential length of the shape of the intermediate product in the design of the shape of the intermediate product in FIG. 2.

FIGS. 2(*a*), (*b*) show a side view of the shape finally required (X-Y plane), a top view (X-Z plane), and cross-sectional views (Y-Z planes). When producing a product of this shape from a pipe with an outside diameter of 2r (radius r) by hydroforming, it is necessary to expand the ranges of the cross-section A-A to cross-section G-G into complicated shapes as shown in the figure. In general, with hydroforming, internal pressure inside the pipe and axial pushing from the two pipe ends are used to expand the pipe into a complicated shape, but when expanding the pipe in both the Y-direction and Z-direction like with the above shape, shaping becomes extremely difficult. In particular, this is difficult with a material with a low shapeability (material with low n value, r value, elongation, etc.) or a shape with a large expansion ratio. Shaping sometimes even becomes impossible.

In such a case, in the past, the working process was divided into several steps and the expansion ratio was gradually increased. For example, when expanding the stock pipe from the circumferential length La to the circumferential length Lc of the final product shape, the circumferential length Lb of the intermediate product shape is set to a value of an intermediate extent between La and Lc (for example, (La+Lc)/2) and the process of pipe expansion is divided into two steps. Shape wise as well, the shape of the intermediate product was generally designed to an intermediate extent between the stock pipe and the final product shape. However, in the first hydroforming step, at the time of expansion from the circumferential length La of the stock pipe to the circumferential length Lb of the intermediate product shape, work hardening has also been imparted, so heat treatment is required for removing the working strain before the second hydroforming step. Cost wise and production efficiency wise, this is extremely disadvantageous. Further, as a method not involving heat treatment, as shown in Japanese Patent Publication (A) No. 2002-100318, it may be considered to expand the pipe in the Z-direction in the first hydroforming step, then expand it in the Y-direction in the second hydroforming step, but in the case of a complicated shape as with this shape, two steps are not enough for working the pipe to the final product shape. A third hydroforming step for finishing the pipe to a more detailed shape becomes essential.

To solve the above problem, in the working method according to the present invention, first the pipe is expanded in only one direction by the first hydroforming step. In the example of the bottom view of FIGS. 4(*a*) and (*b*), it is expanded in only the Y-direction. This is because expansion in only one direction results in a form of deformation close to simple shear deformation, so large deformation becomes possible. This theory is also utilized in the conventional method of Japanese Patent Publication (A) No. 2002-100318, but with the second hydroforming step of this method, it is actually difficult to cause simple shear deformation. If not adding a counter punch or other measure, bulging occurs at the initial stage of the work, so cracks easily form. As opposed to this, in the present invention, to lower the shaping difficulty in the second hydroforming step, in the first hydroforming step, the pipe is expanded to substantially the same extent of circumferential length as the circumferential length of the final product. This point is the difference from the conventional method. However, in the end, excess material is produced and wrinkles are left, so it is necessary to set the circumferential length of the intermediate product shape to not more than 100% of the circumferential length of the final product shape.

On the other hand, if the circumferential length of the intermediate product shape is shorter than 90% of the circumferential length of the final product shape, the ratio of expansion by the second hydroforming step rises by that extent, so the working process of the second hydroforming step becomes difficult and cracks etc.

easily occur. For this reason, the pipe has to be expanded to give a circumferential length of the intermediate product shape in the first hydroforming of the present invention of at least 90% of the final product shape. If the above procedure is used to set the circumferential length of the intermediate product shape, the result becomes as in the graph of FIG. 3. Note that the upper limit for making the height of the intermediate product in the above direction greater than the height of the final product is not particularly set. To enable the effect of the present invention to be obtained, but reliably prevent wrinkles in the later explained second hydroforming step, making it 200% or less of the height of the final product is preferable (aspect of invention according to above (1)).

Figure 4:
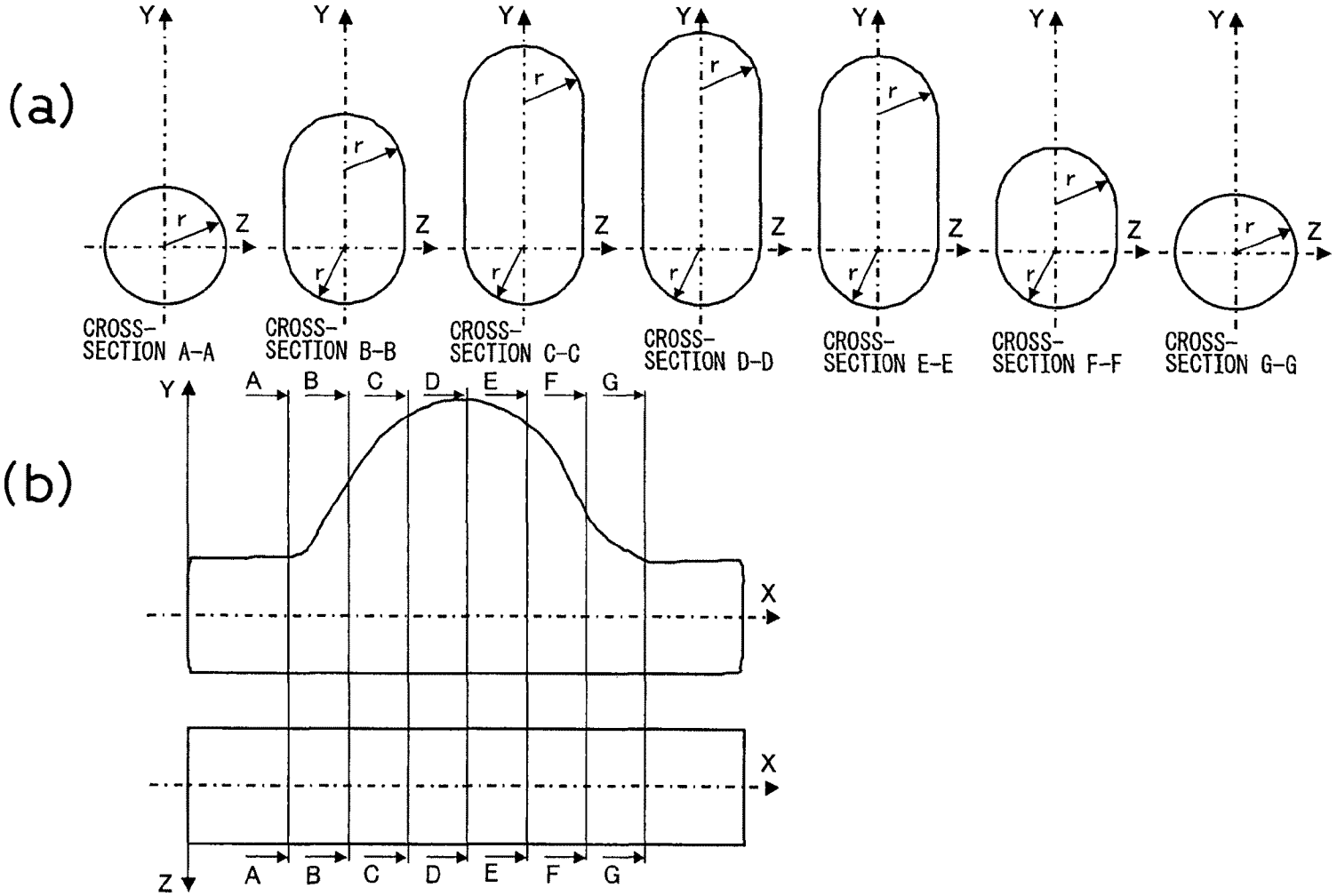
FIG. 4 are views showing explanatory views of a method for designing an intermediate product shape based on a product shape in the present invention, where (a) shows the cross-sectional shapes and (b) shows the side shapes.

As a result of the above, the intermediate product shape shown in FIGS. 4(*a*) and (*b*) is designed. In this example, the pipe is not expanded in the Z-direction of the cross-section, but is expanded to only the Y-direction +side. The circumferential length is set to a range of 90% to 100% of the final product in the entire expanded cross-section. The final product shape shown in FIGS. 2(*a*) and (*b*) is a shape expanded in the Y-direction and Z-direction, so the height in the Y-direction is greater than the case of the final product shape in the entire expanded part in the pipe axial direction (entire cross-sections of A to G other than A and G).

On the other hand, when the shape of the final product has a portion expanded in only the Y-direction, naturally the height of the intermediate product becomes lower than the height of the final product.

Further, the cross-sectional top part and bottom part may be flat in shape, that is, may be rectangular cross-sections, but in this case the thickness is easily reduced near the corner parts, so this becomes disadvantageous in the case of a large expansion ratio. Therefore, as shown in the figure, it is preferable to set a radius of curvature (in the figure, r) substantially equal to the stock pipe (aspect of invention according to above (2)).

Figure 5:
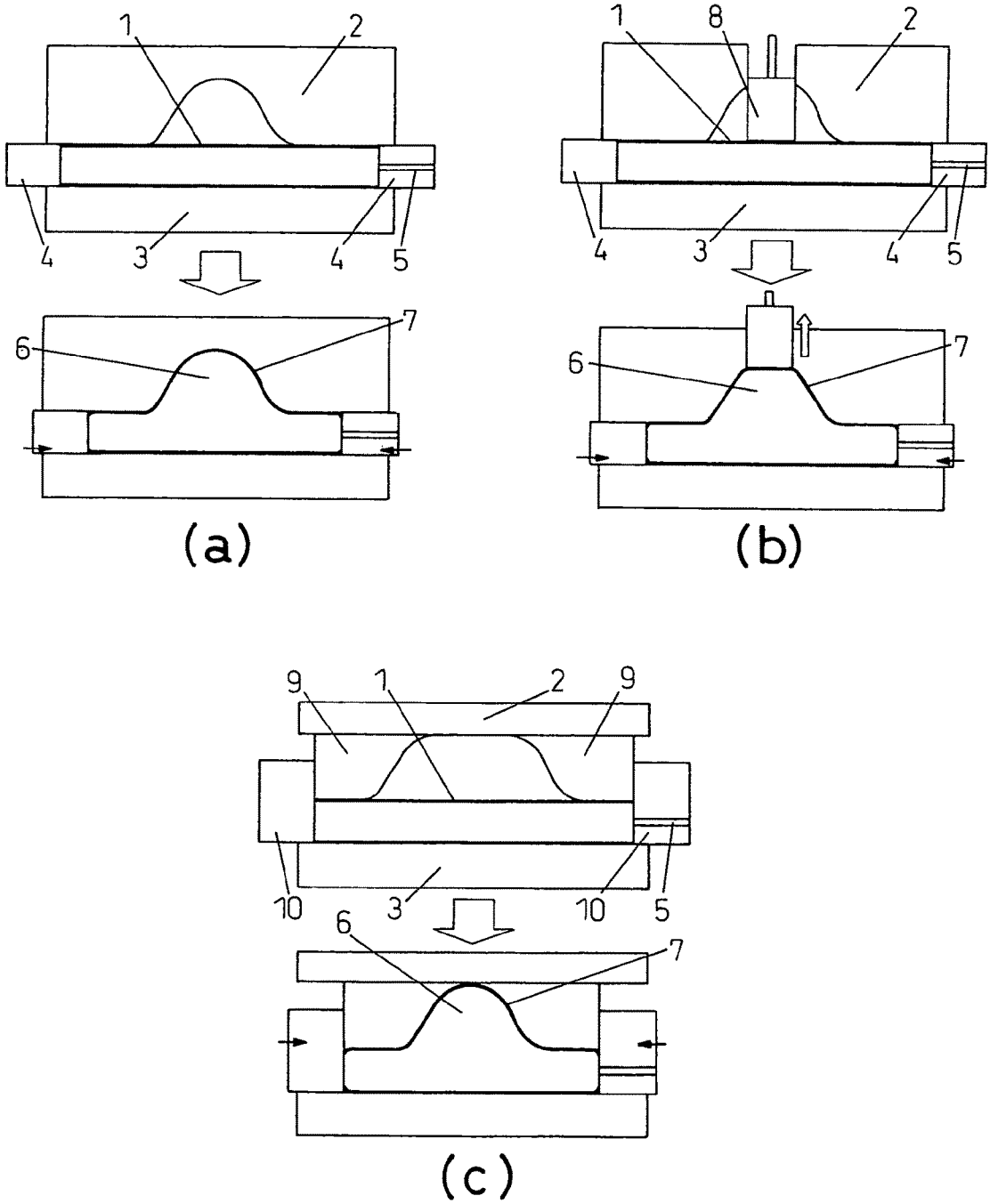
FIGS. 5(*a*), (*b*), and (*c*) are explanatory views of a first hydroforming step in the present invention.

The intermediate product designed by FIGS. 4(*a*) and (*b*) is specifically hydroformed by the procedure as shown in FIG. 5(*a*). That is, the metal pipe 1 is gripped between the top mold 2 and bottom mold 3 of the first hydroforming step, then is pushed in from the two pipe ends by the axial pushing punches 4 and 4. When the final product shape shown in FIGS. 2(*a*) and (*b*) is a shape expanded in the Y-direction and Z-direction, the intermediate product is crushed so as to reduce the height in the Y-direction in the entire expanded cross-section. At this time, simultaneously, water 6 is fed inside the metal pipe 1 from water feed ports 5 provided in the axial pushing punches 4 to raise the internal pressure. As a result, the metal pipe 1 is worked to the shape of the cavity formed by the top mold 2 and bottom mold 3 whereby the intermediate product 7 is obtained.

When the final product has a portion expanded in only the Y-direction, the intermediate product is crushed so as to reduce the height in the Y-direction in part of the expanded cross-section.

Further, when the expansion ratio is large etc., it is also possible to provide a counter punch 8 able to move in a direction perpendicular to the pipe axial direction as shown in FIG. 5(*b*) and perform the hydroforming while suppressing bursting and buckling of the metal pipe 1 (aspect of invention according to above (3)). Further, when the sliding resistance of the straight pipe part is large and the axial pushing action is difficult to convey to the expanded part, as shown in FIG. 5(*c*), it is possible to use a movable mold 9 able to move in the pipe axial direction and simultaneously push the pipe ends and movable mold by the axial pushing punches 10 for hydroforming (aspect of invention according to above (3)).

Figure 6:
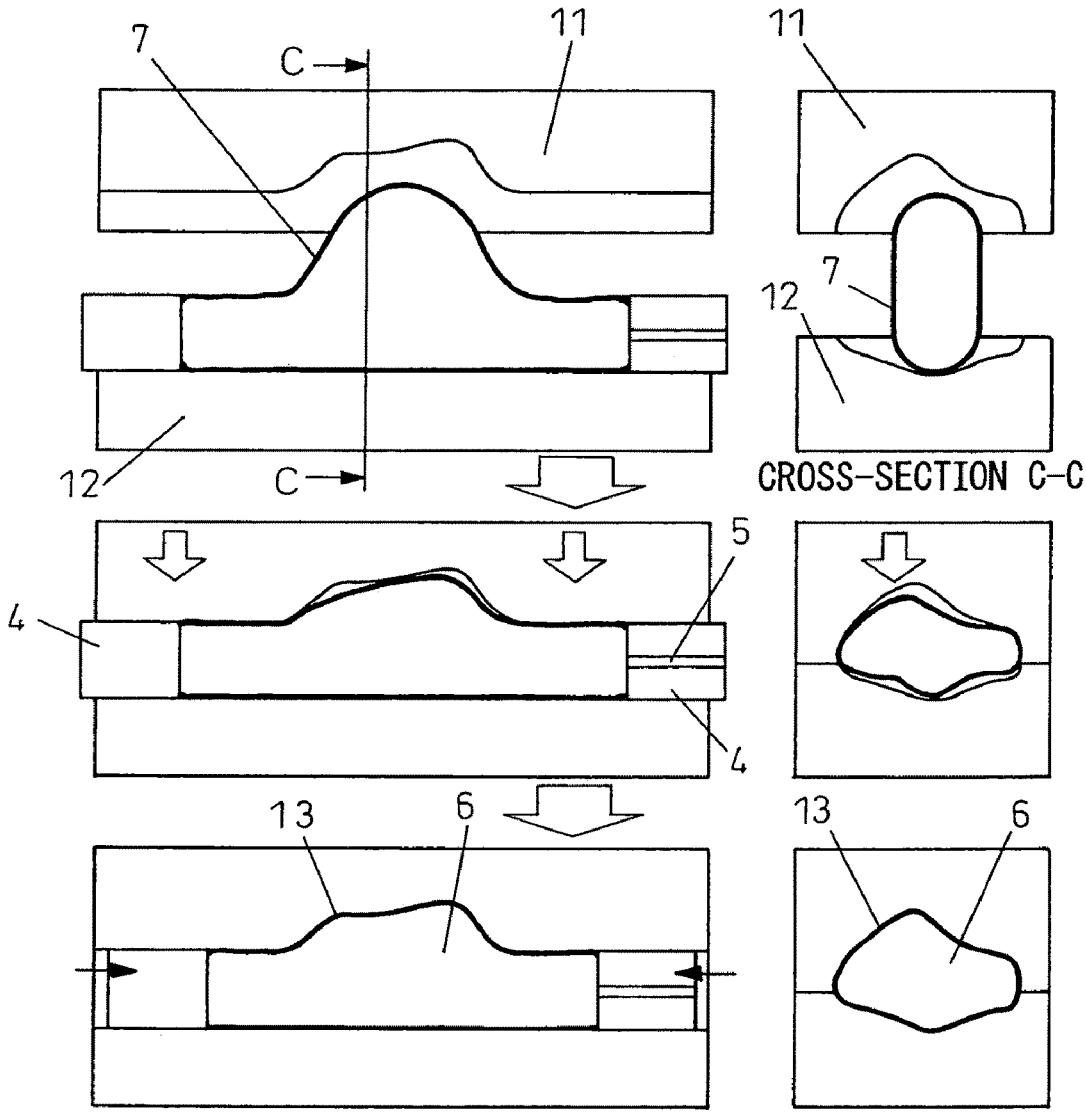
FIG. 6 is a view showing an explanatory view of the second hydroforming step in the present invention.

The intermediate product 7 hydroformed by the procedure of FIG. 5, as shown in FIG. 6, is loaded in the second hydroforming bottom mold 12, then the mold is clamped while the intermediate product 7 is crushed in the Y-direction by the top mold 11 at least at part of the pipe axial direction (while reducing the height of one direction expanded at the first hydroforming step, that is, in the example of FIG. 5, the Y-direction in the cross-section C-C). This being the case, at the portion of the intermediate product worked to reduce the height, the cross-section is enlarged in the Z-direction by the amount of crushing in the Y-direction. At this time, if applying internal pressure and clamping the mold, wrinkling is also suppressed, so this is more effective. After clamping the mold, the usual hydroforming, that is, application of internal pressure and axial direction pushing, is applied to complete the final product 13 formed to the mold shape.

Figure 7:
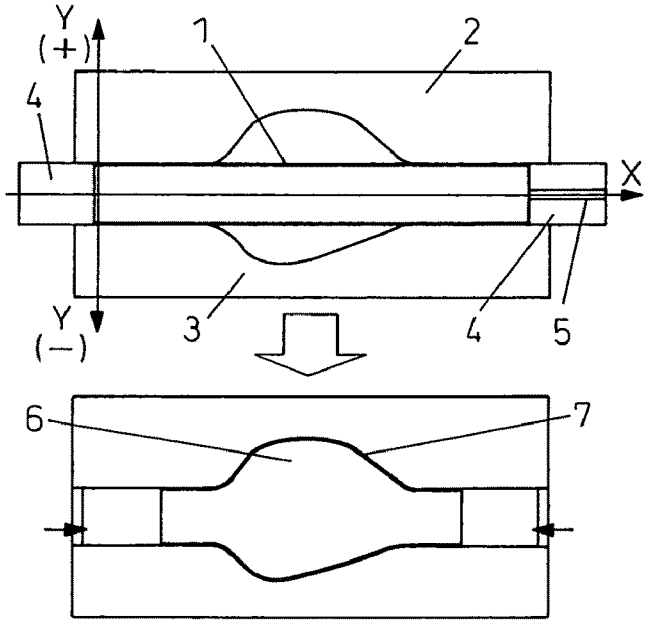
FIGS. 7(*a*) and (*b*) are views showing explanatory views of the first hydroforming step for working a pipe to various shapes of intermediate products in the present invention.
Figure 7:
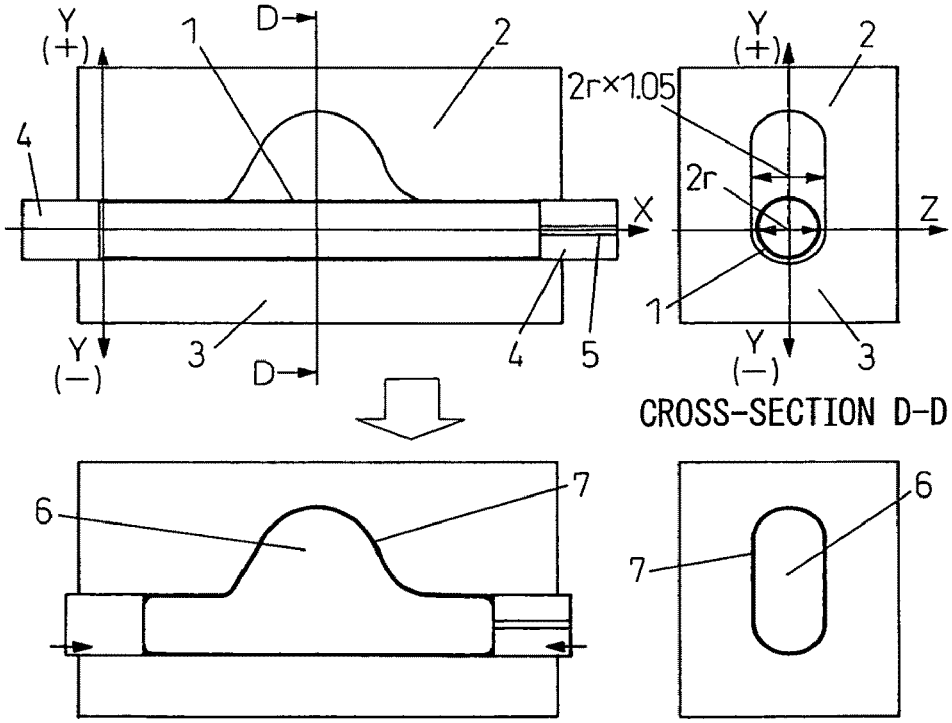

Further, the pipe expansion direction of FIGS. 4(*a*) and (*b*) is made only the +side in the Y-direction, but depending on the shape of the final product, as shown in FIG. 7(*a*), the pipe may also be expanded to both the +side and the −side. Further, expansion in the Z-direction is not completely prohibited either. As shown in FIG. 7(*b*), it is also possible to expand a pipe in the Y-direction while expanding it somewhat in the Z-direction (in the figure, 1.05 times the stock pipe diameter 2r).

Figure 8:
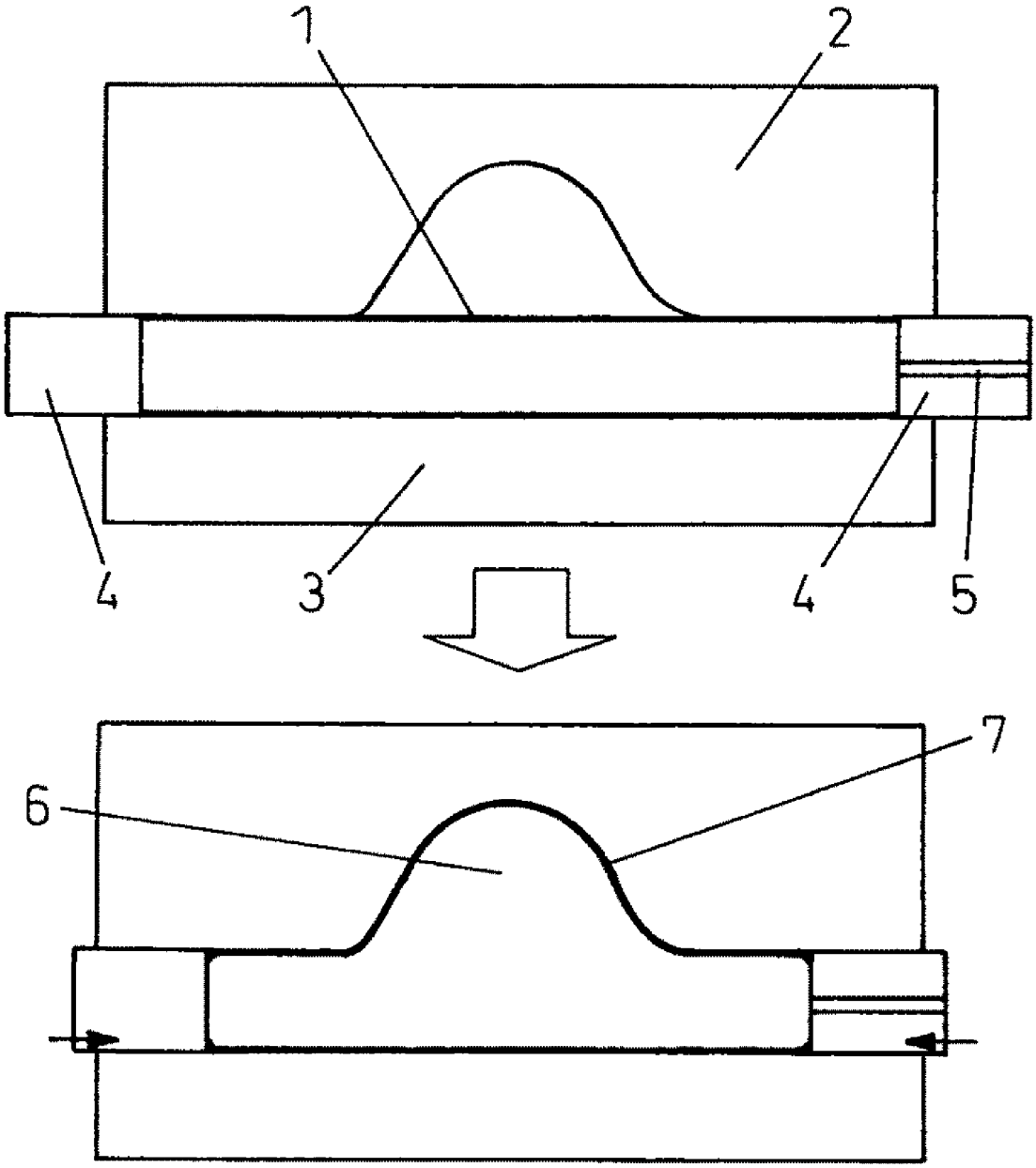
FIG. 8 is a view showing an explanatory view of a working method of the present invention in the case including bending.

Next, an example of interposing bending between the first hydroforming and second hydroforming will be explained (aspect of invention according to above (4)). By the same procedure as in FIG. 2 to FIG. 4, the shape of the intermediate product is designed so that the metal pipe is expanded in one direction in the cross-section (in FIG: 8, made the Y-direction) to a range of 90% to 100% of the circumferential length of the cross-sections of the pipe axial direction of the final product at all of the enlarged part of the pipe axial direction and to become higher than the product height at least at part of the pipe axial direction. In this first hydroforming step, the pipe is worked into a straight shape in the pipe axial direction as shown in FIG. 8 to obtain the intermediate product 7. This is because a straight shape is easy to push, so this is also advantageous for shaping with a large expansion ratio.

Figure 9:
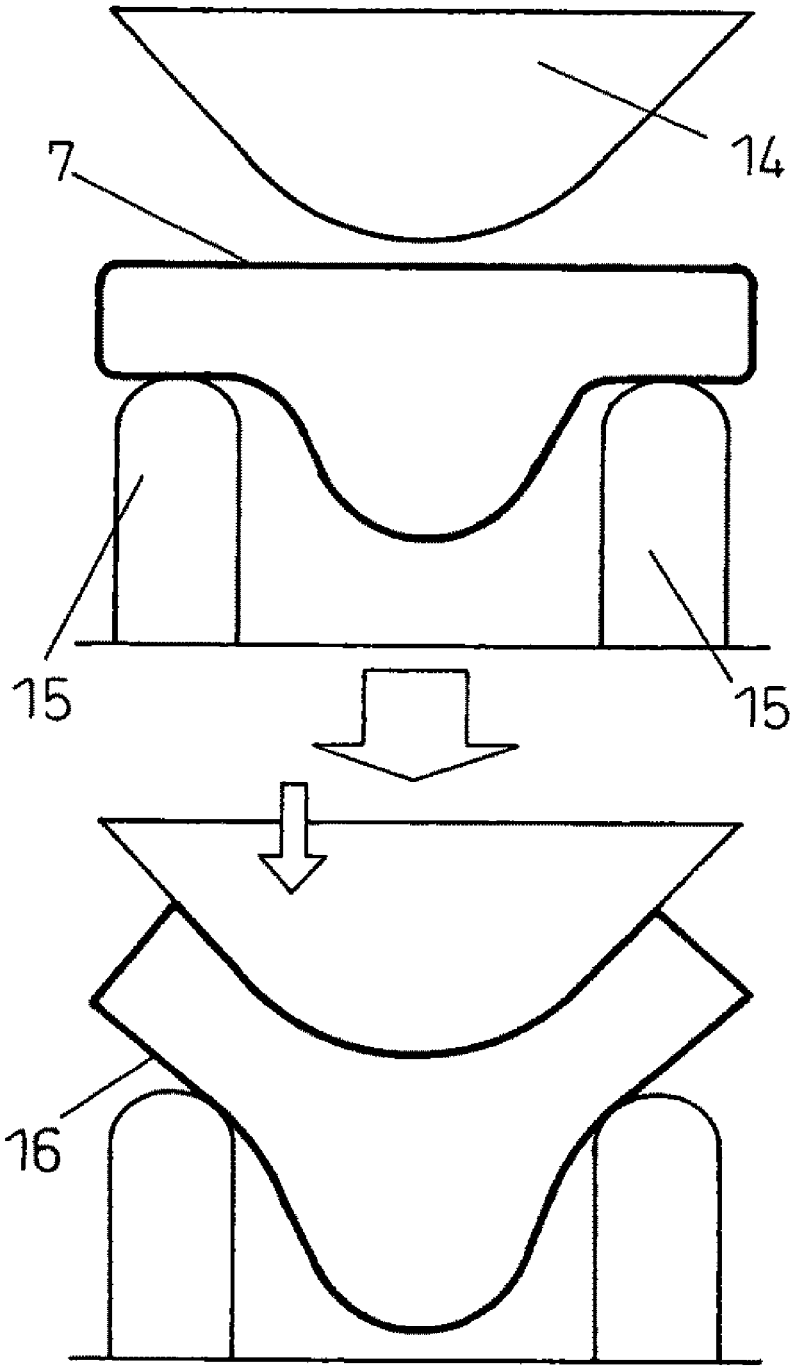
FIG. 9 is a view showing an explanatory view of a working method of the present invention in the case including bending following FIG. 8.
Figure 10:
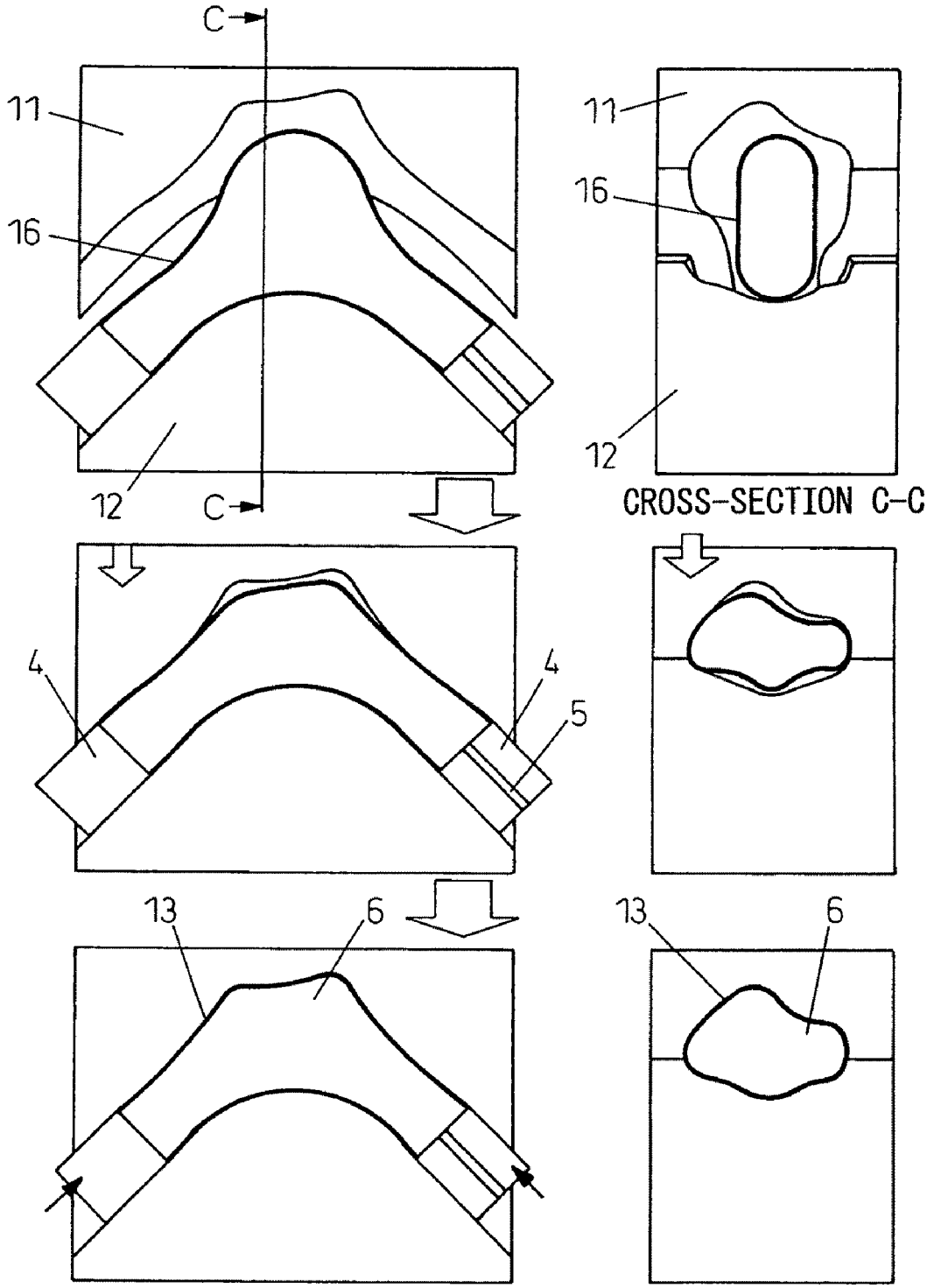
FIG. 10 is a view showing an explanatory view of a working method of the present invention in the case including bending following FIG. 9.

After this, as shown in FIG. 9 and FIG. 10, the intermediate product 7 is bent. The bending method may be the rotary bending method, press bending method, or any other method. These may be selectively used according to the size and material of the pipe the bending radius, etc. Note that these figures are examples of the relatively simple bending method of three-point bending by a press. That is, the first hydroformed intermediate product 7 is placed on the fulcrums 15 and 15, then a punch 14 is pushed in from above to obtain a bent intermediate product 16. Further, the position of the expanded part with respect to the bending is not limited to the outside of the bend like in this example. It may also be anywhere else such as at the inside of the bend or the side. At that time, it is preferable to prevent the expanded part from being crushed by the bending punch 14 or fulcrums 15, but if in the range not a problem in the later second hydroforming step, the expanded part may be deformed a bit.

Finally, the bent intermediate product 16 is loaded into the second hydroforming bottom mold 12 and the mold is clamped while crushing the product by the top mold 11 at least at part of the pipe axial direction (while reducing Y-direction height), then internal pressure and axial pushing are applied. These procedures are the same as the procedure explained with reference to FIG. 6. After the above series of working steps, finally a final product 13 both bent and hydroformed is obtained.

EXAMPLE 1

Below, an example of the present invention will be shown.

Figure 11:
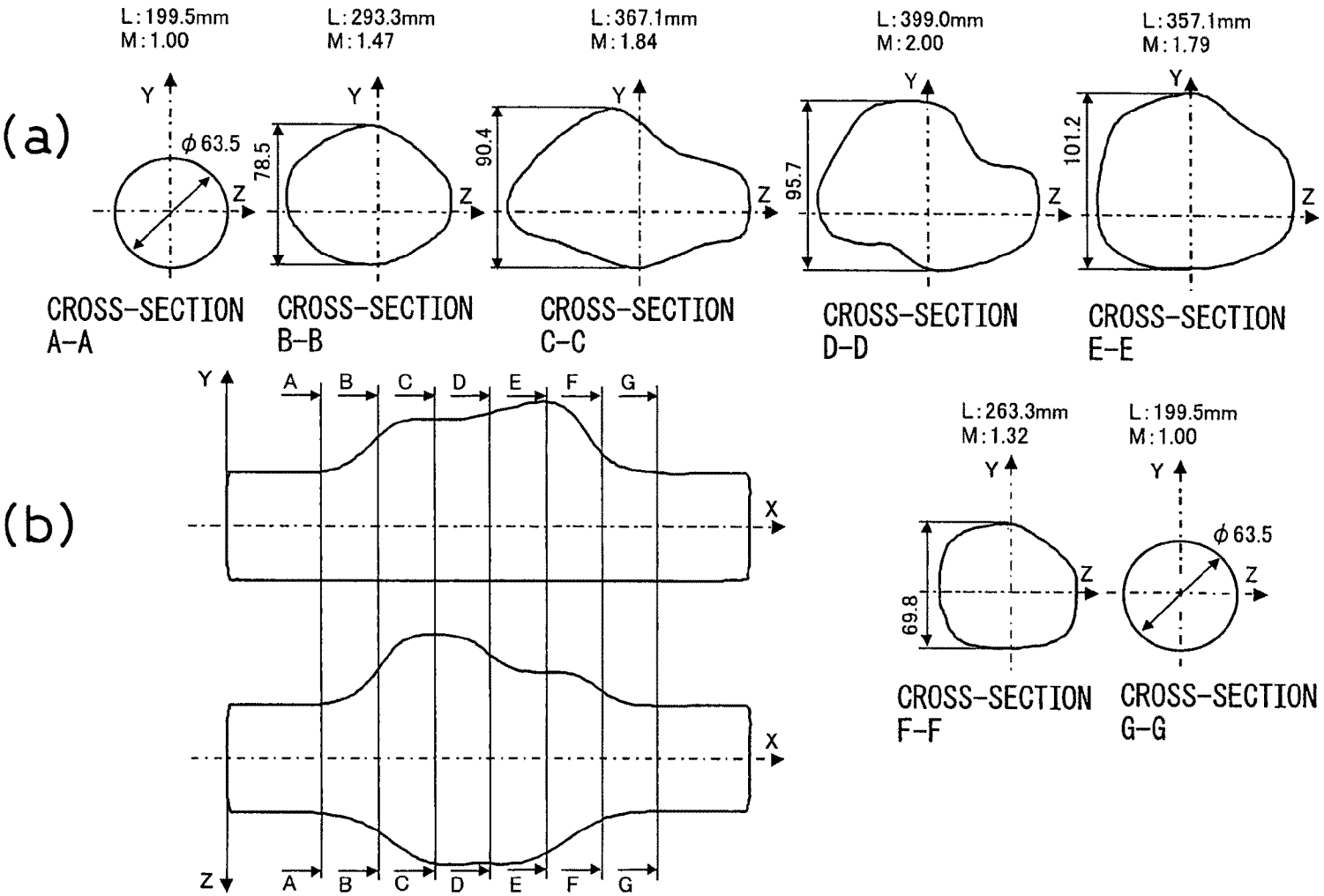
FIG. 11 are views showing explanatory views of a method for designing an intermediate product shape based on a product shape in the present invention, where (a) shows the cross-sectional shapes and (b) shows the side shapes.
Figure 12:
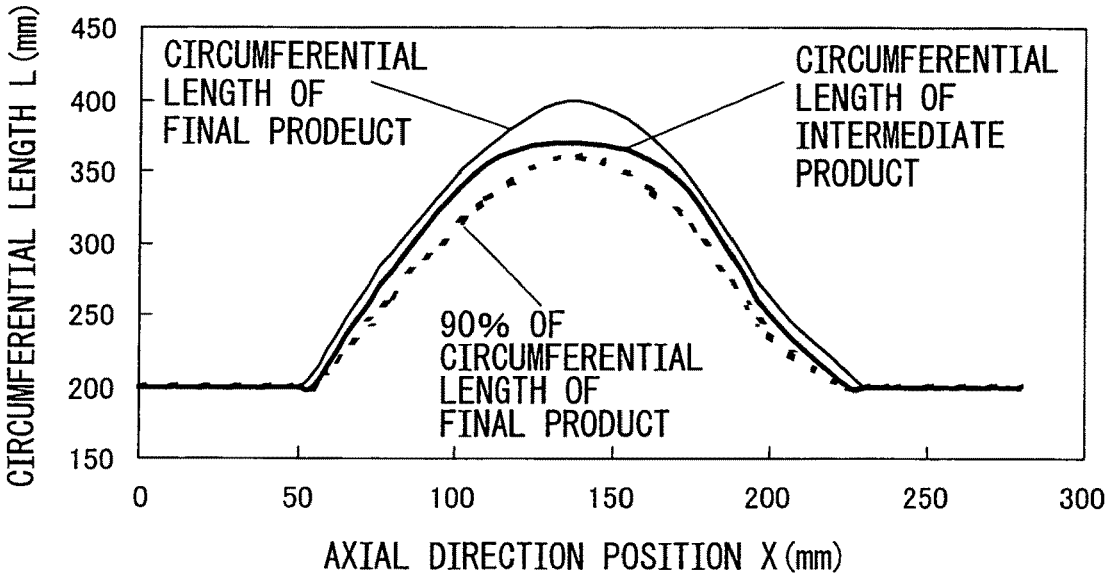
FIG. 12 is a view showing the circumferential length of the shape of the final product and the circumferential length of the shape of the intermediate product in the design of the shape of the intermediate product in FIG. 11.
Figure 13:
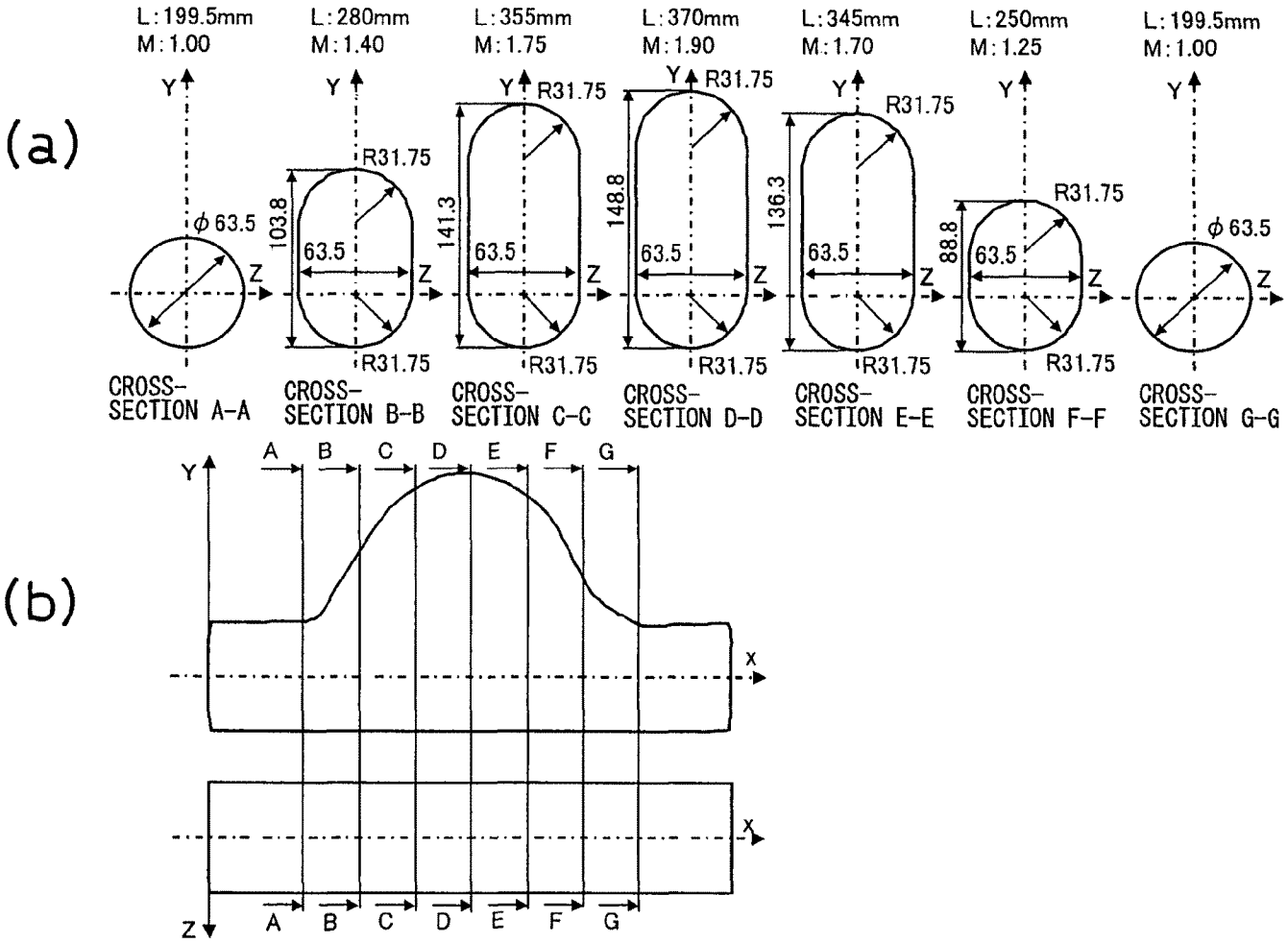
FIG. 13 are views showing explanatory views of a method for designing an intermediate product shape based on a product shape in the present invention, where (a) shows the cross-sectional shapes and (b) shows the side shapes.
Figure 14:
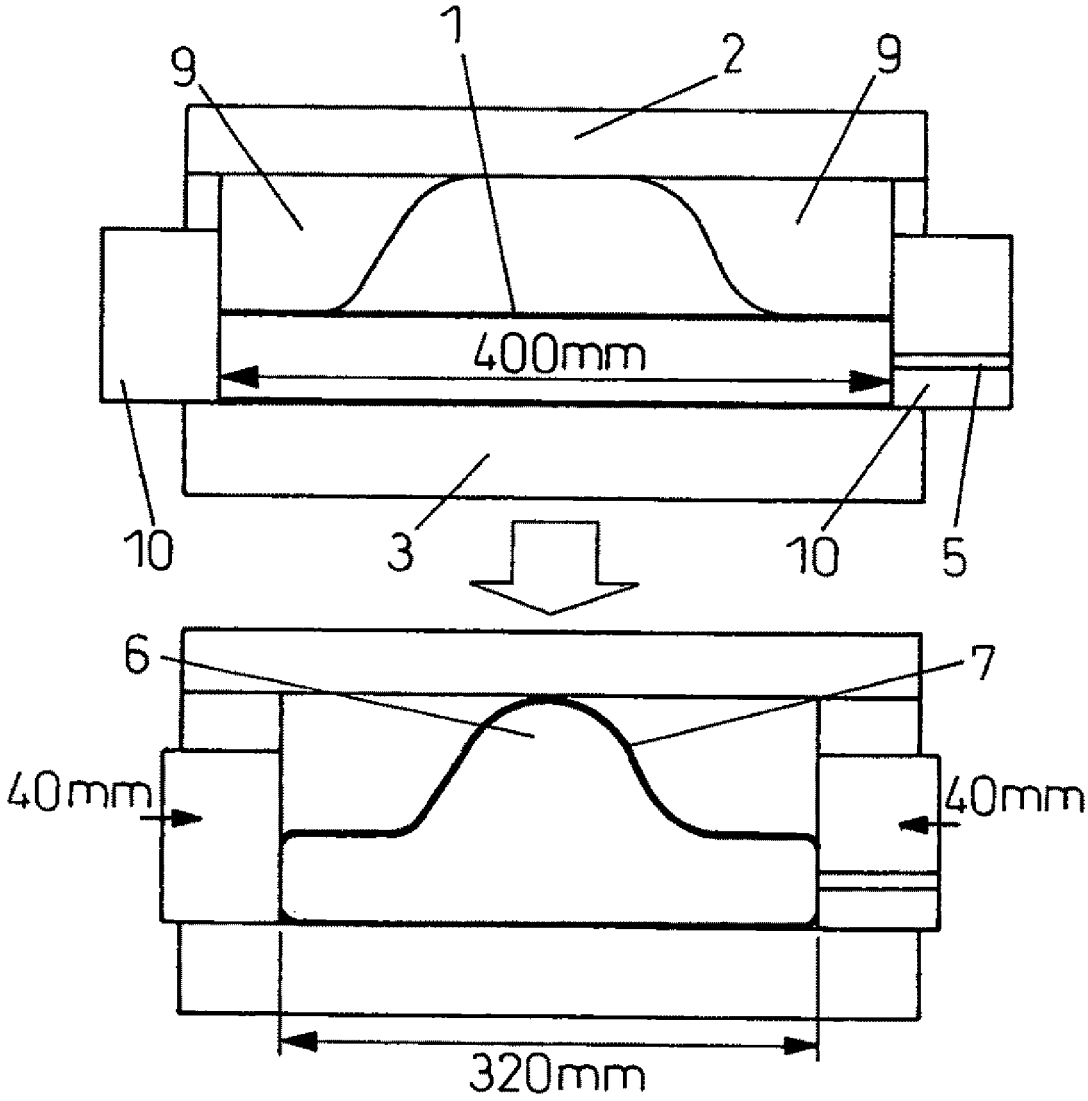
FIG. 14 is a view showing an explanatory view of an example of the first hydroforming step and the second hydroforming step.

As the metal pipe, steel pipe of an outside diameter of 63.5 mm, a thickness of 2.3 mm, and a total length of 400 mm was used. The steel type is STKM11A of carbon steel pipe for machine structural use. The product shape is shown in FIGS. 11(*a*) and (*b*). It is a shape with a maximum expansion ratio of 2.00 and expanded in both the Y-direction and Z-direction of the cross-section. The distribution of the circumferential length is shown by the fine line of the graph of FIG. 12. The circumferential length of the intermediate shape (bold line in FIG. 12) was set to become a range between the product circumferential length and 90% of that value (broken line in the figure) for the entire expanded part in the pipe axial direction. The cross-sectional shapes of the intermediate product are designed so as to match with the set circumferential length. At that time, for the shape of the intermediate product, as shown in FIGS. 13(*a*) and (*b*), the dimension in the Z-direction of the cross-section was made the same as the outside diameter of the stock pipe, that is, 63.5 mm. Only the Y-direction dimension was changed in the axial direction (X-direction). The final product in this example had a shape not expanded to the Y-direction −side, so even the intermediate product was made a shape not expanded in the Y-direction −side, but only in the +side. Further, the shapes above and below the cross-section (Y-direction +side and −side) are made semicircular shapes of the same radius of curvature as the stock pipe, that is, 31.75 mm.

The intermediate product designed as explained above was worked by the mold shown in FIG. 14. The expansion ratio in this example is relatively large, so to greatly suppress the reduction in thickness at the time of hydroforming, the hydroforming was performed using a movable mold 9 able to move in the pipe axial direction. As the working conditions of this first hydroforming step, the internal pressure was made 32 MPa and the amount of axial pushing was made 40 mm for both two ends. Note that at the time of axial pushing, axial pushing punches 10 able to push the movable mold 9 simultaneously with the ends of the metal pipe 1 were used. At the time of completion of hydroforming, the total length becomes 320 mm and the shape becomes the shape of the intermediate product designed by FIG. 11 to FIG. 13.

Figure 15:
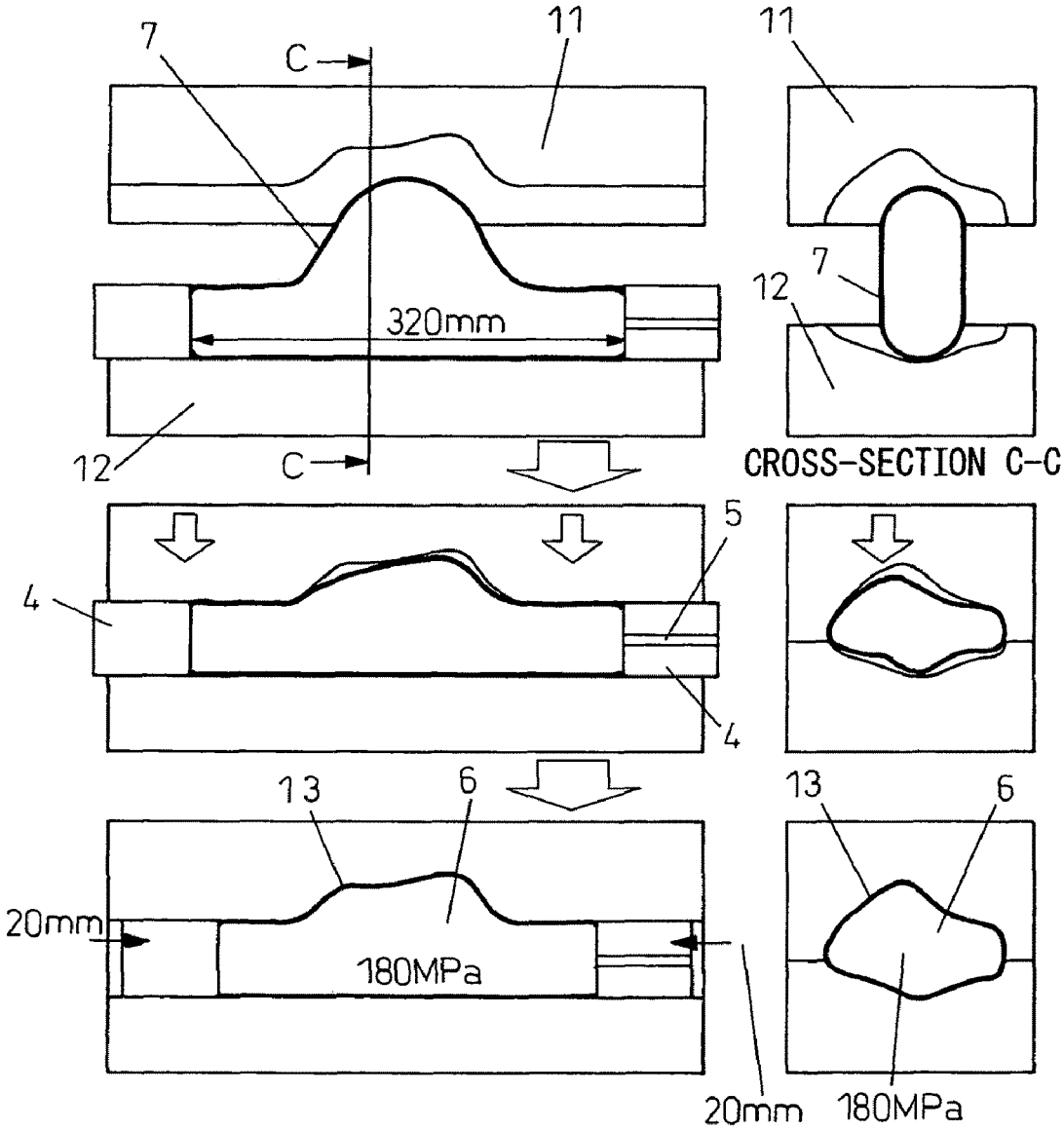
FIG. 15 is a view showing an explanatory view of an example of the hydroforming steps following FIG. 14.

Next, the intermediate product 7 was placed in the second hydroforming bottom mold 12 shown in FIG. 15, then the top mold 11 was lowered from above to clamp the mold so as to reduce the Y-direction height in the entire expanded cross-section. Finally, hydroforming was performed applying an internal pressure and axial pushing. As the working conditions of the second hydroforming step, the internal pressure was applied up to a maximum of 180 MPa, while the axial pushing was applied from the two ends by 20 mm each.

By the above series of working methods, it was possible to obtain a worked part expanded by an expansion ratio of 2.00 and further in cross-section in both the Y-direction and Z-direction. Further, working could be performed by only the two steps of the first hydroforming and second hydroforming.

EXAMPLE 2

Figure 16:
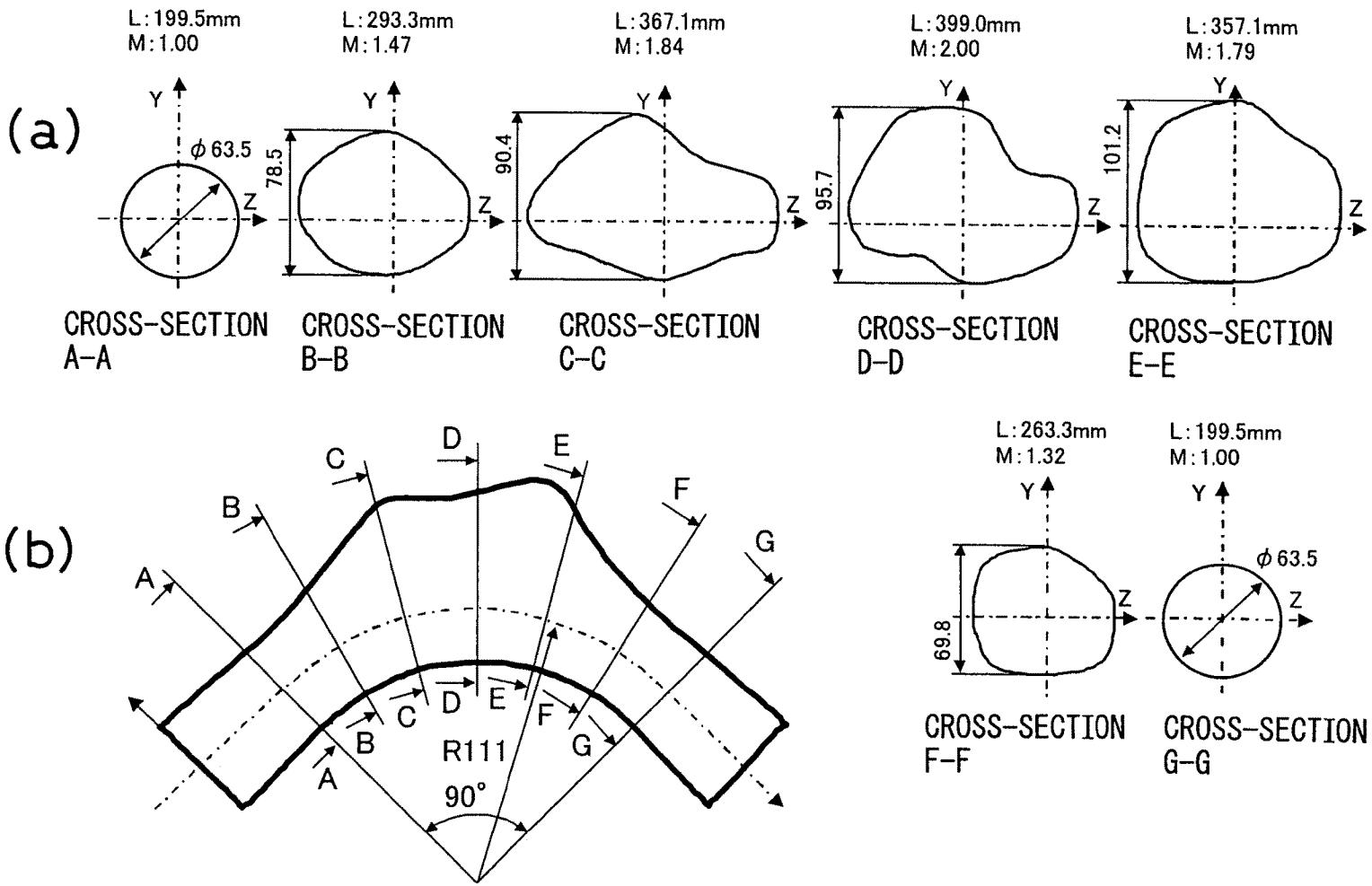
FIG. 16 are views showing explanatory views of an example for designing an intermediate product shape based on a product shape in the case of a shape including a bend, where (a) shows the cross-sectional shapes and (b) shows the side shapes.
Figure 17:
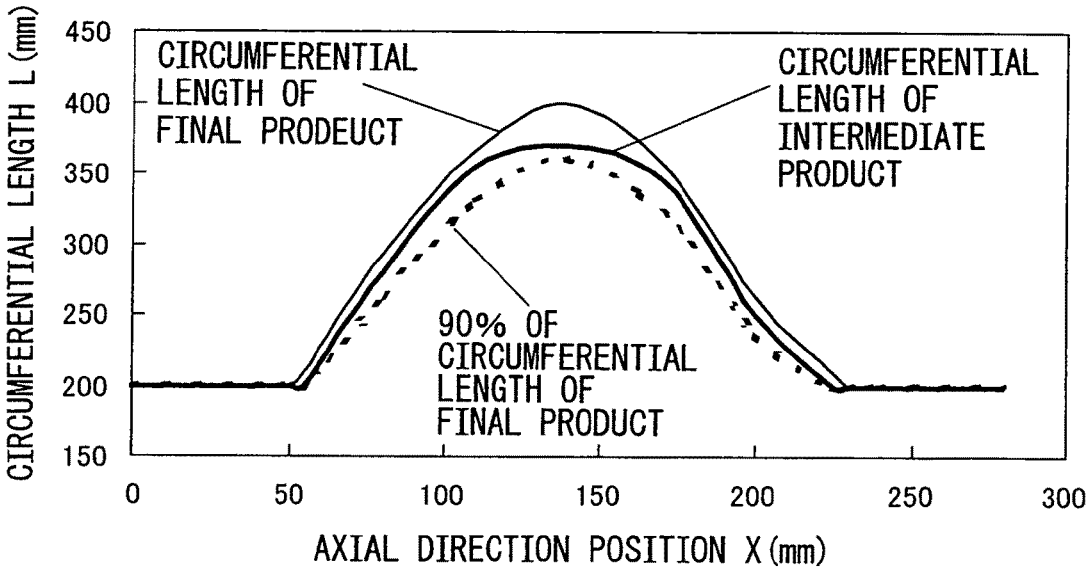
FIG. 17 is a view showing the circumferential length of the shape of the final product and the circumferential length of the shape of the intermediate product in the design of the shape of the intermediate product in FIG. 16.
Figure 18:
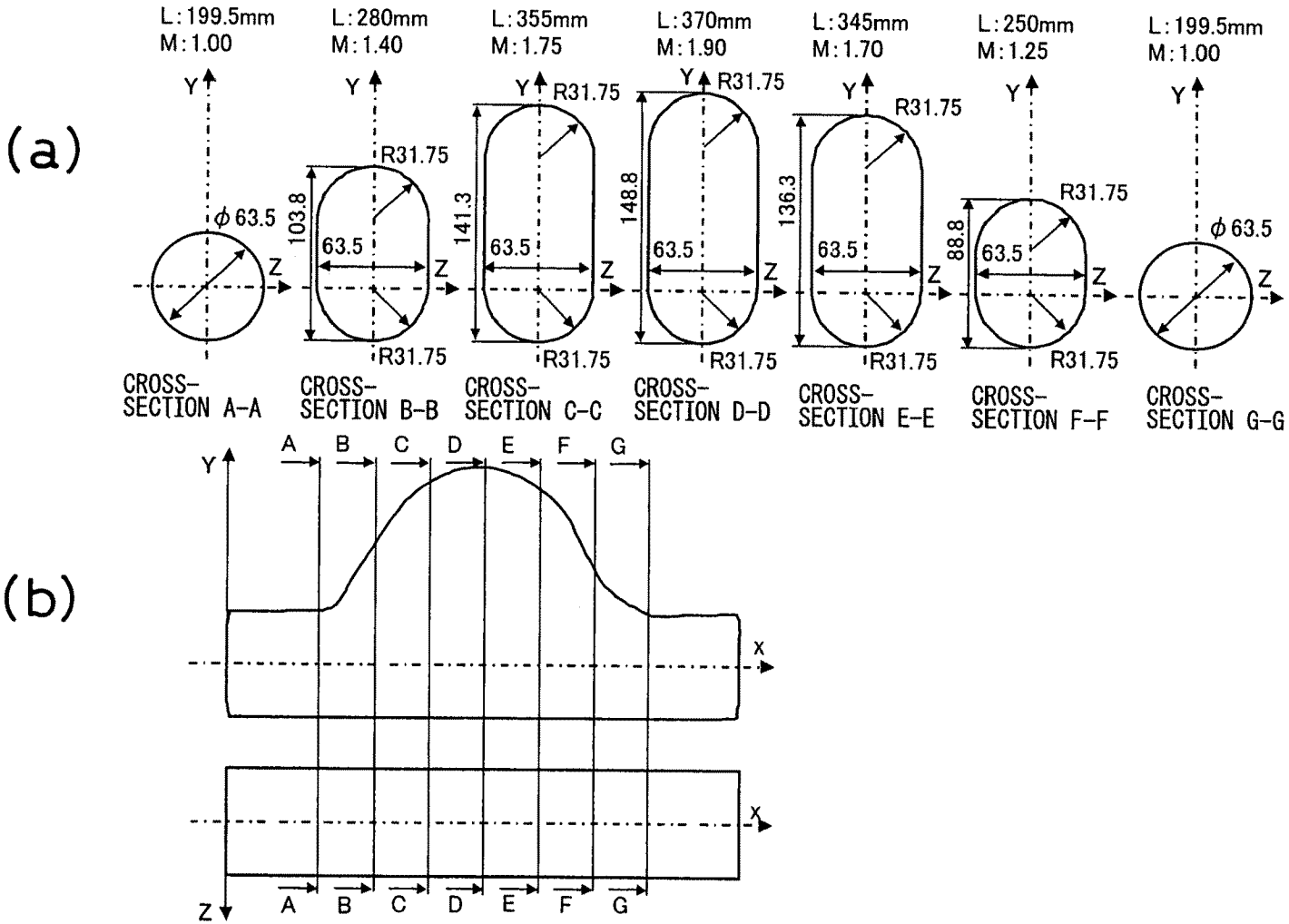
FIG. 18 are views showing explanatory views of another example for designing an intermediate product shape based on a product shape in the case of a shape including a bend, where (a) shows the cross-sectional shapes and (b) shows the side shapes.

Next, an example of a product with a shape including bends will be explained. FIG. 16 and FIG. 18 show the outline of the design of the intermediate product shape. Basically, this is the same as the procedure of FIG. 11 to FIG. 13 explained with reference to Example 1. The pipe axial direction of the final product was set as the X-axis and the circumferential lengths in the different cross-sections vertical to this X-axis were investigated. Further, the circumferential length of the intermediate product is designed by the method shown in FIG. 17 to become a range of 90% to 100% of the product circumferential length for the entire expanded part in the pipe axial direction (X-axis). Note that the cross-sections of the final product of the Example 2 were made the same as the cross-sections of the final product of the above-mentioned Example 1. The shape of the intermediate product is designed so as to match with the circumferential length of the intermediate product. The procedure at this time was also the same as the case of Example 1. The cross-sectional dimensions were increased to the +side in only the Y-direction. However, the shape in the pipe axial direction (X-direction) is made a straight shape. This, is because rather than expanding a bent shape, a straight shape facilitates flow of the material in the pipe axial direction.

The pipe is worked to the shape of the intermediate product designed above by the first hydroforming step, but the cross-sectional shapes become the same as in Example 1. Further, since a straight shape, the first hydroforming step becomes exactly the same shape as Example 1. Therefore, the mold used in the first hydroforming step of Example 1 was used to obtain the intermediate product 7 by the procedure of FIG. 14.

Figure 19:
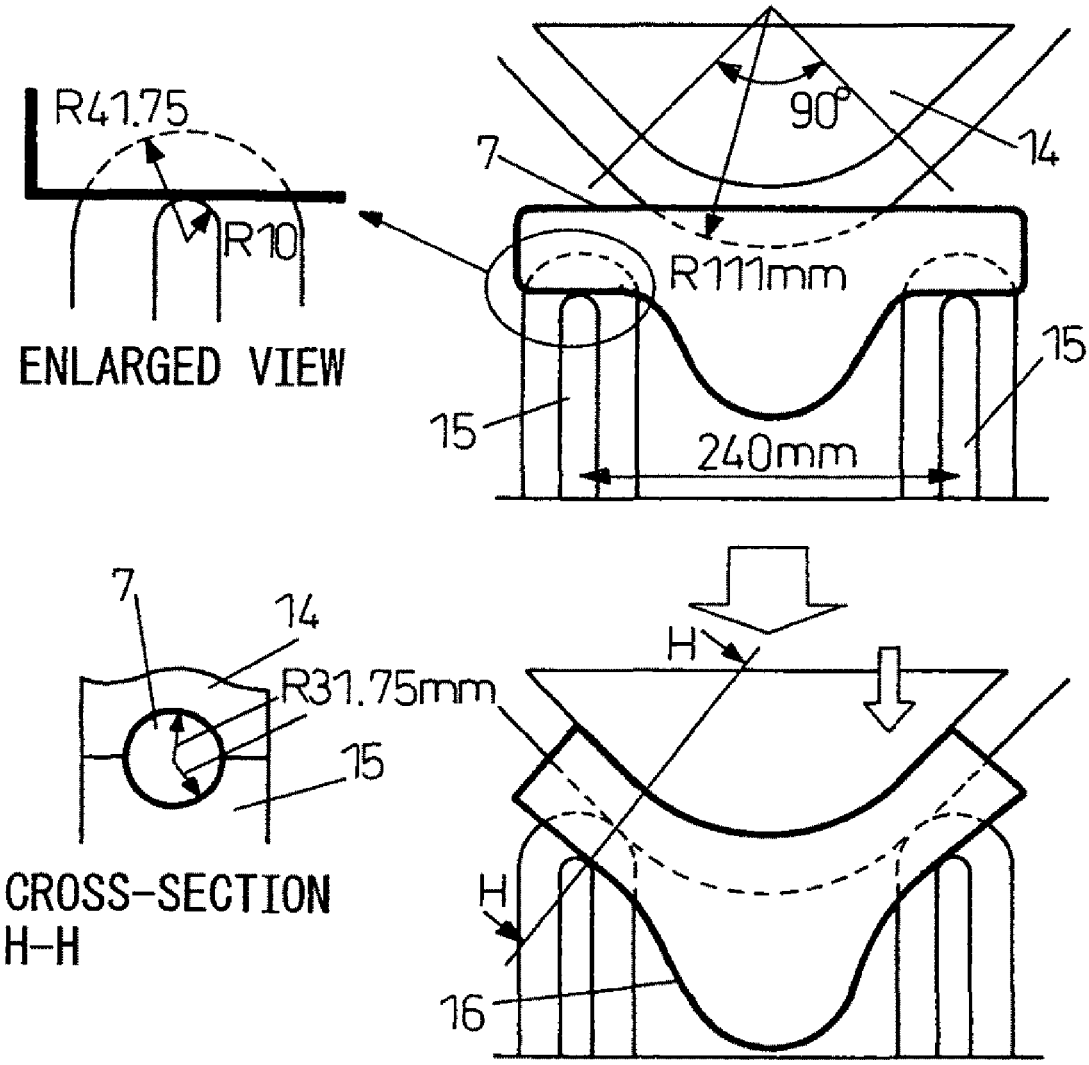
FIG. 19 is a view showing an explanatory view of the different steps in the case including bending.

Next, the intermediate product 7 was bent by three-point bending. As shown in FIG. 19, the distance between fulcrums 15 and 15 was made 240 mm. A punch 15 with a radius of 111 mm and an angle of 90° was pushed in from above to bend the intermediate product 7. Note that the punch 14 and the fulcrums 15 are provided with semicircular grooves of a radius of 31.75 mm, the same as the straight pipe part of the intermediate product 7, so that the intermediate product 7 is not crushed at the time of bending.

Figure 20:
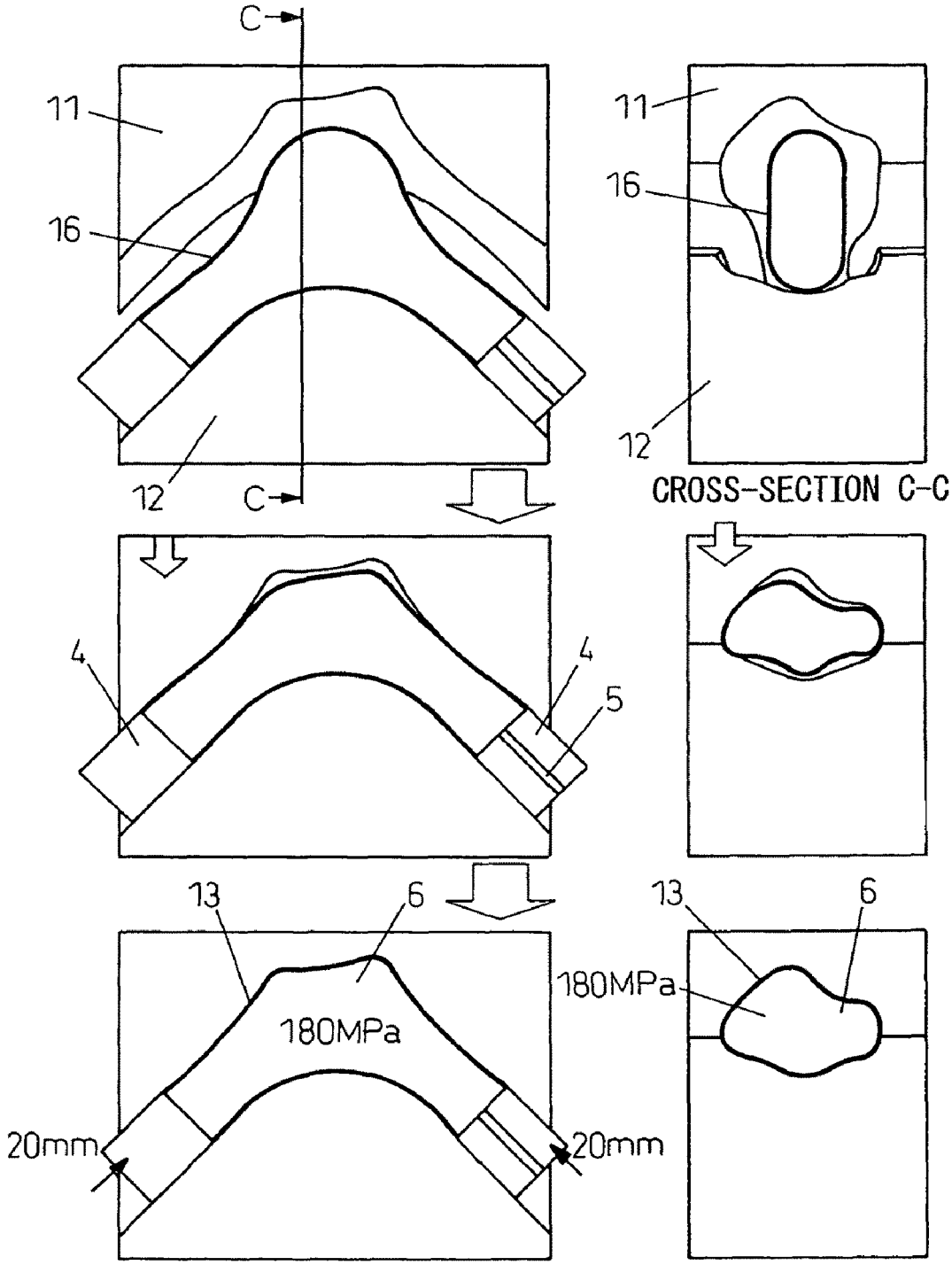
FIG. 20 is a view showing an explanatory view of the different steps in the case including bending following FIG. 19.

The intermediate product 16 obtained by the above bending was placed on a bottom mold 12 of the second hydroforming step shown in FIG. 20, then the top mold 11 was lowered from above to clamp the molds so as to reduce the Y-direction height in the entire expanded cross-section. Finally, an internal pressure of a maximum pressure of 180 MPa and 20 mm axial pushing from the two ends were applied.

As a result of the above series of working steps, it was possible to obtain a shaped part with a bent part with an expansion ratio of 2.00 and greatly expanded in cross-section in both the Y-direction and Z-direction.

Industrial Applicability

According to the present invention, the scope of application of hydroforming is expanded compared with the past and the types of pipe shaped parts for automobiles are increased. Due to this, automobiles can be made further lighter in weight, the fuel economy can be improved, and suppression of global warming can be contributed to as well.

The invention claimed is:

1. A method of hydroforming a metal pipe to form a final product, in which a metal pipe is loaded into a divided mold, the mold is clamped, and then an internal pressure is applied in the metal pipe, and a pushing force is applied in an axial direction of the metal pipe, the metal pipe having an X axis along the axial direction of the metal pipe, and Y and Z axis in the metal pipe cross-section, the method comprising:

in a first hydroforming step, expanding the metal pipe in an expanded direction in the Y axis only of the cross-section of the metal pipe to obtain an intermediate product, having an expanded part in the expanded direction, wherein the expanded part has a circumferential length of 90% to 100% of the circumferential length of the shape of the final product in all of the expanded part in the metal pipe axial direction, and a height greater than the height of the final product in the expanded direction and at least part of the pipe axial direction, then, in a second hydroforming step, reducing the height in the expanded direction of the intermediate product and expanding at least in the Z axis direction in all or part of the pipe axial direction while shaping the product to the final product shape.

2. The hydroforming method as set forth in claim 1, wherein a radius of curvature of a cross-section of the metal pipe and a radius of curvature of a cross-section in the expanded direction are substantially equal.

3. The hydroforming method as set forth in claim 1, further comprising shaping the pipe into the intermediate product with a movable mold able to freely move in the axial direction of the metal pipe and a counter punch able to freely move in a direction perpendicular to the axial direction of the metal pipe.

4. The hydroforming method as set forth in claim 1, further comprising bending the intermediate product in the pipe axial direction between the first hydroforming step and second hydroforming step.

* * * * *